US009669447B2

(12) United States Patent
Flehmig et al.

(10) Patent No.: US 9,669,447 B2
(45) Date of Patent: Jun. 6, 2017

(54) METHOD AND DEVICE FOR DRAWING AND TRIMMING BLANKS

(75) Inventors: Thomas Flehmig, Ratingen (DE); Konstantinos Savvas, Oberhausen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 13/569,525

(22) Filed: Aug. 8, 2012

(65) Prior Publication Data

US 2013/0019648 A1 Jan. 24, 2013

Related U.S. Application Data

(63) Continuation of application No. PCT/EP2011/052880, filed on Feb. 28, 2011.

(30) Foreign Application Priority Data

Mar. 2, 2010 (DE) ..... 10 2010 000 608

(51) Int. Cl.
*B21D 24/16* (2006.01)
*B21D 22/21* (2006.01)

(52) U.S. Cl.
CPC ..... *B21D 24/16* (2013.01); *B21D 22/21* (2013.01)

(58) Field of Classification Search
CPC ..... B21D 28/343; B21D 24/26; B21D 24/16; B21D 22/21
USPC ... 72/327, 326, 234, 333, 275, 276, 34, 324, 72/347, 348, 24; 83/689, 636, 690, 596
See application file for complete search history.

(56) References Cited

U.S. PATENT DOCUMENTS

| | | | | |
|---|---|---|---|---|
| 1,665,203 | A * | 4/1928 | Delf | 72/327 |
| 2,237,069 | A * | 4/1941 | Christenson | 30/360 |
| 5,630,337 | A * | 5/1997 | Werth | 72/349 |
| 6,981,327 | B2 * | 1/2006 | Nordlin | 83/689 |
| 2008/0229802 | A1 * | 9/2008 | Simris | 72/348 |
| 2012/0282482 | A1 * | 11/2012 | Flehmig et al. | 428/603 |

FOREIGN PATENT DOCUMENTS

| | | | |
|---|---|---|---|
| DE | 3218923 | A1 | 12/1982 |
| JP | 1034525 | A | 2/1989 |
| JP | 5050156 | A | 3/1993 |
| JP | 8168830 | A | 7/1996 |

* cited by examiner

*Primary Examiner* — David Bryant
*Assistant Examiner* — Pradeep C Battula
(74) *Attorney, Agent, or Firm* — Reinhart Boerner Van Deuren P.C.

(57) ABSTRACT

The invention relates to a device for drawing components from a blank (1) made of metal using a drawing punch (2) and a die (3), the drawing punch (2) having a cutting edge (4) for trimming the blank (1) during the drawing procedure and a run-in contour (5) being provided in the die (3). The invention also relates to a method for drawing a blank using the device according to the invention and to a use according to the invention of the method. The run-in contour (5) of the die (3) is configured such that the cutting edge (4) and the run-in contour (5) are only in cutting engagement in certain regions in the drawing punch position at the start of the cutting procedure along the cutting line (7).

7 Claims, 2 Drawing Sheets

METHOD AND DEVICE FOR DRAWING AND TRIMMING BLANKS

CROSS-REFERENCE TO RELATED PATENT APPLICATIONS

This patent application is a continuation of International Application No. PCT/EP2011/052880 filed on Feb. 28, 2011, which claims the benefit of German application No. 10 2010 000 608.4 filed on Mar. 2, 2010, the teachings and disclosure of which are hereby incorporated in their entirety by reference thereto.

FIELD OF THE INVENTION

The invention relates to a device for drawing components from a metal blank using a drawing punch and a die, the drawing punch having a cutting edge for trimming the blank during the drawing procedure and a run-in contour being provided in the die. The invention also relates to a method for drawing a blank using the device according to the invention as well as to a use according to the invention of the method.

BACKGROUND OF THE INVENTION

It is known to draw blanks made of a metal, in particular steel or aluminium and, during the drawing procedure, to edge or trim the drawn part at the same time. Thus, for example, it is known from Japanese patent application JP 01034525 to provide a drawing punch with a cutting edge, which punch trims the blank during the drawing procedure, thereby producing a flange-free component. However, it has been found that in the known method, the cutting forces are very high and it is not always possible to ensure a clean cut of the blank due to these high cutting forces. Furthermore, in the conventional trimming of blanks, it is known to form the cutting edge obliquely based on the plane of the metal sheet so that when the cutting edge is lowered onto the blank, the cutting engagement travels along the cutting line with a progressing movement of the cutting edge until the complete separation has been achieved. However, the cutting edge of the drawing punch is used at the same time to jointly determine the contour of the drawn component and/or to compress the component, for example. Therefore, it is usually impossible to position this cutting edge obliquely. Reducing the cutting forces without changing the contour of the drawn component is thus not easily possible.

It is also known to provide the die of a device for drawing blanks with a run-in contour. The run-in contour is the region of the die in which the actual mould recess of the die merges into the border. The largest possible radius is provided as the run-in contour to facilitate the drawing procedure, so that the material flow of the blank does not have to take place over a narrow radius.

SUMMARY OF THE INVENTION

On this basis, the object of the invention is to provide a device and a method by which the cutting forces during integrated drawing and trimming can be reduced without influencing the contour of the component. A further object of the present invention is to provide a corresponding production method.

According to a first teaching of the present invention, the object indicated above is achieved by configuring the run-in contour of the die such that the cutting edge and the run-in contour are only in cutting engagement in certain regions in the drawing punch position at the start of the cutting procedure along the cutting line.

The run-in contour of the die which is used to facilitate the drawing procedure is generally configured as a larger radius which is usually configured to be identical along the cutting line to uniformly facilitate the drawing procedure along the entire run-in curve. With this characteristic of the run-in contour, the cutting engagement of the cutting edge takes place simultaneously along the entire cutting line. In contrast to this, the run-in contour according to the invention is configured such that the cutting edge of the drawing punch produces a cutting engagement of the cutting edge only in certain portions at the start of the cutting process so that the entire cutting line is not simultaneously in cutting engagement via the cutting edge. The minimum requirement for a clean cut of the blank is for the run-in contour of the die to provide the cutting engagement at least at one point, based on the drawing punch position in which the cutting procedure starts. Starting from this point, the cutting engagement of the cutting edge moves during further downwards movement along the cutting line until the drawn blank is completely separated from the trimmed part. The run-in contour can ensure this, for example, by the use of different radii along the cutting line so that the run-in contour already has the final shape of the die at different heights relative to the base of the die in different positions along the cutting line and thus only allows the cutting engagement pointwise or in certain regions. Due to the cutting engagement which results therefrom and which moves along the cutting line, the cutting forces and also the wear of the device, in particular of the cutting edge are significantly reduced.

Preferably, the device is designed to draw blanks made out of steel. For this purpose, for example specific steel qualities have to be provided on the cutting edge and/or the dimensions of the die and of the drawing punch have to be adapted to the flow behaviour of the material to be worked.

According to a first configuration of the device according to the invention, the cutting edge of the drawing punch is simultaneously configured to form the finished contour of the component and it runs optionally in a plane perpendicular to the drawing movement of the drawing punch. If required, the finished contour of the component is also compressed by the cutting edge of the punch. Since according to the invention the formation of the cutting edge can be formed almost independently of the cutting engagement to be realised, it can be easily adapted to the respective shape of the component and used for shaping the drawn component, in particular the end face of the borders of a drawn component. This is achieved in that the run-in contour of the die ensures the operation of the moving cutting engagement of the cutting edge. A particularly simple cutting edge can then be provided in that the cutting edge runs in a plane perpendicular to the drawing movement of the drawing punch. Forming of the drawn component thereby also produces a planar component in the region of the shaping of the cutting edge or of the end faces of the borders of the component.

A further embodiment of the device according to the invention ensures a uniform cutting procedure in that the run-in contour is configured to vary along the cutting line. In the context of the present invention, "vary" means that on changing the position of the drawing punch after the start of the cutting procedure, the cutting procedure moves along the cutting line until the complete separation from the trimmed part is achieved. According to a further embodiment, the run-in contour is graduated in the direction of the cutting line so that regions of the cutting line are in each case simultaneously in cutting engagement with the cutting edge and are severed simultaneously.

According to a further embodiment of the device according to the invention, if the run-in contour has a tooth-like or undulating profile along the cutting line, the cutting engagement can take place simultaneously at different points of the cutting line and a continuous trimming can be simultaneously performed at a plurality of points of the cutting line.

Due to the shape of the run-in contour, said run-in contour has along the cutting line at least one point where the cutting procedure commences, i.e. where the run-in contour initially merges into the die shape based on the drawing punch position.

The trimming of the blank continues progressively from this position in the direction of the lowest point of the run-in contour. In the case of a multiple engagement, the cutting edge of the drawing punch simultaneously engages at a plurality of points in the drawn blank and starts the cutting procedure.

According to the invention, the cutting angle between the cutting edge and the run-in contour is from 1° to 5° to achieve good cutting results.

According to a second teaching of the present invention, the object indicated above is achieved in terms of the method in that the cutting edge of the drawing punch and the run-in contour of the die are in cutting engagement only in certain regions and at least at one point of the cutting line in the punch position at the start of the cutting procedure along the cutting line and the blank is cut continuously along the cutting line by the movement of the drawing punch into the die starting from the cutting engagement point or points.

As already mentioned, as a result of the method according to the invention, not only is a clean trimming of the blank achieved during the drawing procedure, but the cutting forces are also effectively reduced so that the wear on the cutting edge is reduced and the cutting procedure is harmonised significantly. Overall, an improved method is provided which is suitable for drawing and simultaneously trimming high unit numbers of blanks.

The method according to the invention can be further improved in that on reaching the end position of the drawing punch, the cutting edge of the punch forms the contour of the component in the region of the cutting edge and/or performs a compression of the component. Since the different cutting engagement points are already established with the run-in contour of the die, the formation of the cutting edge can be configured such that the contour of the component is formed in the region of the cutting edge, for example in the case of a cup-shaped component, the front edge of the borders of the component, and that is independently of the realisation of continuing the trimming procedure during the drawing procedure. The end faces of the borders of the drawn component are preferably formed flat and in a plane to ensure a joining possibility of the component via the end faces of the borders.

Finally, the use of the method according to the invention is advantageous for producing drawn steel components for motor vehicles. In the case of motor vehicle parts, high numbers of good quality units are regularly required at a low cost. The use of the method according to the invention for producing components for vehicles can allow in one working step not only components of a high quality, but also high numbers of units of these components due to the reduced wear of the device according to the invention.

BRIEF DESCRIPTION OF THE DRAWINGS

In the following, the invention will be described in more detail with reference to drawings in conjunction with exemplary embodiments. In the drawings.

DETAILED DESCRIPTION OF THE INVENTION

Figure 1:
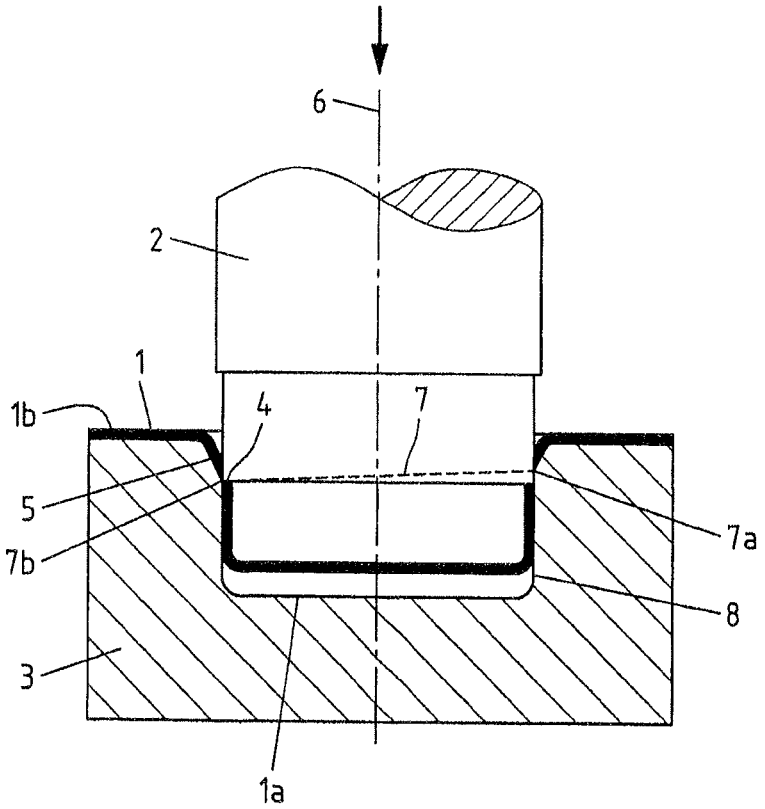
FIG. 1 is a sectional view of a first exemplary embodiment of a device according to the invention.

FIG. 1 is a schematic sectional view of a first exemplary embodiment of the device according to the invention. The device comprises a drawing punch 2 which, using the die 3, draws the blank 1 into a cup-shaped component, for example, and trims it at the same time. During the drawing procedure, the cutting edge 4 of the drawing punch 2 causes on the one hand that, from a particular drawing position of the drawing punch 2 into the die 3, for the blank 1 the cutting procedure starts. In this respect, the run-in contour 5 is configured such that it has an eccentricity with respect to the axis of symmetry 6 of the drawing punch 2 and thus also in respect of the axis of symmetry of the contour of the die 3. The cutting line 7 which marks the cutting engagement between cutting edge and run-in contour of the die has a vertical profile. In the present exemplary embodiment, the cutting engagement of the cutting edge 4 takes place from a position of the punch 2 initially at point 7*a*, since here the run-in contour merges into the end contour 8 of the die 3 even at a lower drawing depth. If the punch 2 is moved further in the direction of die 3, the cutting edge 4 of the punch 2 continuously cuts the drawn blank 1 starting from the cutting line point 7*a*, until the cut at point 7*b* has completely separated the drawn part of the blank 1*a* from the trimmed part 1*b*. This ensures that the cutting procedure is initiated only in certain regions and at least at one point 7*a* during the drawing procedure. The trimming of the blank during the drawing procedure then no longer requires high forces because the complete cutting line is not in the cutting engagement of the cutting edge 4 and the die 3.

The complete separation of the drawn part of the blank 1*a* and the trimmed part 1*b* must take place at the latest by the time the drawing punch 2 has reached its end position. However, trimming is preferably carried out before the punch 2 has reached its end position in order to form the end faces of the borders of the finished component via the cutting edge 4 and optionally to compress them.

Figure 2:
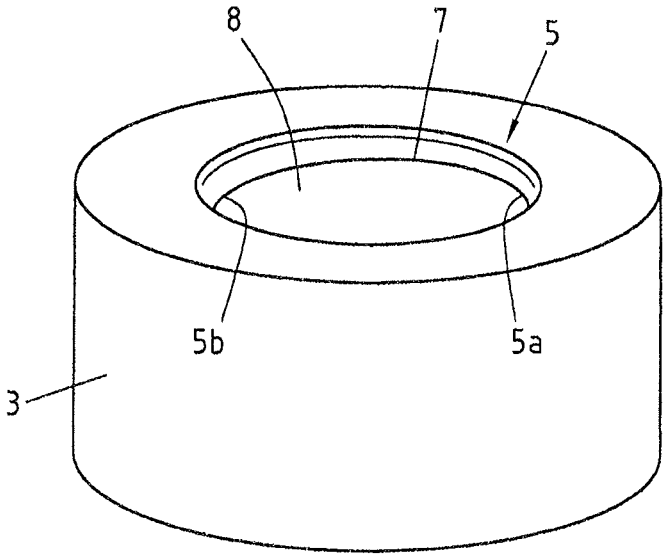
FIG. 2 is a perspective view of the die according to the first exemplary embodiment.

FIG. 2 is a perspective view of the configuration of the die of the exemplary embodiment from FIG. 1. The die 3 has a run-in contour 5 which merges into the end contour 8 of the die 3 at different heights in respect of the drawing direction. In FIG. 2, these points are denoted by 5*a* and 5*b*. At point 5*a*, the run-in contour 5 of the die 3 merges into the end contour 8 of the die 3, for example even at a lower drawing depth of the punch 2, so that the cutting engagement between cutting edge 4 and blank 1 takes place even at a lower drawing depth. The cut then continues from point 5*a* until, encircling in both directions, it reaches cutting point 5*b*. At point 5*b* of the cutting line, the run-in contour 5 of the die 3 finally merges into the end contour 8 of the die so that the cutting engagement between cutting edge and blank finally takes place here. The cutting edge can be rectilinear due to the configuration of the run-in contour 5 of the die 3, still allowing a continuous cutting procedure which only requires low cutting forces.

Figure 3:
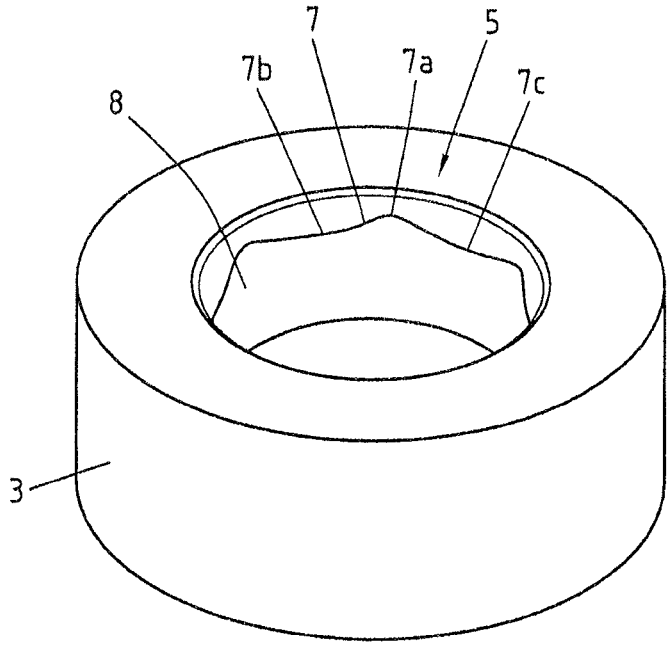
FIG. 3 is a perspective view of a second exemplary embodiment, and FIG. 4*a*), *b*) are schematic illustrations of the profile of the run-in contour of two further exemplary embodiments along the cutting line of a die.

FIG. 3 is a perspective view of a further exemplary embodiment of the die 3. The run-in contour 5 is configured along the cutting line 7 with a tooth-like vertical profile so that the cutting line denotes at cutting point 7*a* the start of the cutting engagement between cutting edge and blank. Therefore, the trimming procedure of the blank starts at point 7*a* and continues with further displacement of the position of the drawing punch into the die to the lowest point of the cutting line 7*b*. As can be seen from the example in FIG. 3, the cutting engagement into the blank takes place simultaneously at a plurality of points of the cutting line 7. The trimming procedure then continues from these points of cutting line 7*a* to the lower points of cutting line 7*b*, 7*c* when the punch is moved lower into the die 3. Thus, the blank will be in cutting engagement with the cutting edge of the drawing punch in certain regions and simultaneously at a plurality of points and will be continuously trimmed during displacement of the drawing punch into the die.

Figure 4A:
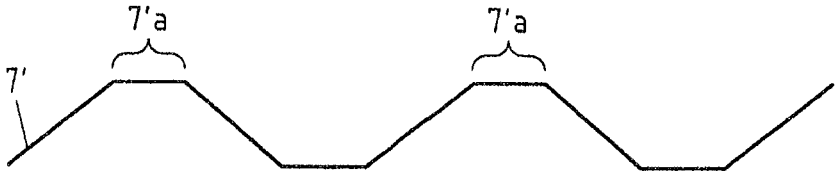
Figure 4B:
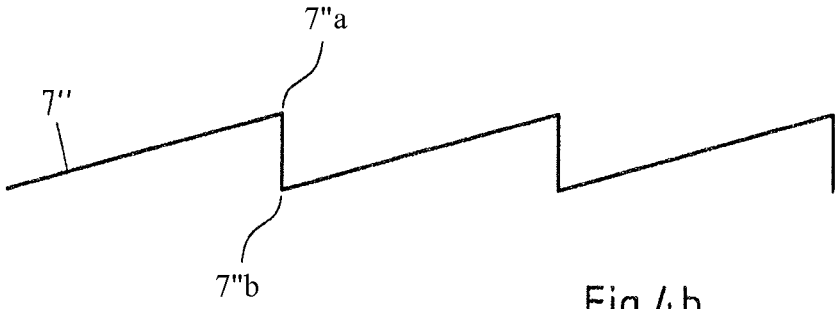

FIG. 4*a*) and FIG. 4*b*) schematically show profiles of the run-in contour which represent the vertical profile of the transition of the run-in contour into the end contour of the die. The cutting lines 7' and 7" of FIGS. 4*a*) and 4*b*) indicate the vertical profile of the run-in contour 5 of the die 3. Cutting line 7' shows that regions 7'*a* initiate the cutting procedure in certain regions during the plunging of the drawing punch. Cutting line 7" again shows a tooth-like profile, the cutting engagement taking place in each case at the highest points 7"*a* and then continuing to the lowest point 7"*b*. FIGS. 4*a*) and 4*b*) are exemplary embodiments according to the invention of the run-in contour of the die 3 of a device according to the invention. It is of course possible for the run-in contour to be undulating, for example sinusoidal or to have other vertical profiles.

The invention is not restricted to the illustrated cup-shaped, non-flanged component, but can also be applied to deep-drawn parts of any type and shape, and can be applied in particular to flanged components.

The invention claimed is:

1. Device for drawing components from a blank made of metal comprising a drawing punch and a die, the drawing punch having a cutting edge for trimming the blank during a drawing procedure and a run-in contour being provided in the die, wherein the run-in contour of the die defines a cutting line and said run-in contour is configured such that the cutting edge and the run-in contour are only in cutting engagement in certain regions and not along the entire cutting line in the drawing punch position at the start of the cutting procedure along the cutting line defined by the die.

2. Device according to claim 1, wherein the cutting edge of the drawing punch is simultaneously configured to form and compress a finished contour of the component.

3. Device according to claim 1, wherein the run-in contour varies or is graduated along the cutting line.

4. Device according to claim 1, wherein the run-in contour has a tooth-like or undulating profile along the cutting line.

5. Device according to claim 1, wherein the cutting edge of the drawing punch is simultaneously configured to form a finished contour of the component.

6. Device according to claim 1, wherein the cutting edge of the drawing punch is simultaneously configured to compress a finished contour of the component.

7. Device according to claim 1, wherein the cutting edge is disposed in a plane perpendicular to the drawing movement of the drawing punch.

* * * * *